US007681542B2

(12) United States Patent
Paul et al.

(10) Patent No.: US 7,681,542 B2
(45) Date of Patent: Mar. 23, 2010

(54) CAMSHAFT ADJUSTMENT DEVICE

(75) Inventors: Enrico Paul, Berlin (DE); Uwe Reuter, Berlin (DE); Holger Rudzinski, Berlin (DE); Ulrich Stubbemann, Berlin (DE)

(73) Assignee: Daimler AG, Stuttgart (DE)

( * ) Notice: Subject to any disclaimer, the term of this patent is extended or adjusted under 35 U.S.C. 154(b) by 196 days.

(21) Appl. No.: 11/998,843

(22) Filed: Nov. 30, 2007

(65) Prior Publication Data

US 2009/0159024 A1 Jun. 25, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,107,804 A 4/1992 Becker et al.
5,657,725 A 8/1997 Butterfield et al.
7,000,580 B1 2/2006 Smith et al.
2005/0103294 A1 * 5/2005 Heinze et al. ..... 123/90.17

FOREIGN PATENT DOCUMENTS

| | | |
|---|---|---|
| DE | 42 29 201 | 3/1994 |
| DE | 42 29 201 | 3/2003 |
| DE | 10 2004 035 035 | 3/2005 |
| EP | 1 221 540 | 7/2002 |
| EP | 1 596 039 | 11/2005 |
| EP | 1 705 345 | 9/2006 |

* cited by examiner

*Primary Examiner*—Zelalem Eshete
(74) *Attorney, Agent, or Firm*—Klaus J. Bach

(57) ABSTRACT

In an adjustment device for adjusting the phase position of a camshaft relative to a crankshaft of an internal combustion engine which includes a hydraulic system for supplying hydraulic fluid under pressure to the adjustment device for the controlled admission to, and release thereof from, operating chambers of the adjustment device under the control of a control device including a control valve, the operating chambers are in communication with one another via control valves to permit flow of hydraulic fluid from one set of operating chambers to another by the varying torques effective on the camshaft or by controlling fluid supply to the operating chambers from the hydraulic fluid supply system.

18 Claims, 20 Drawing Sheets

CAMSHAFT ADJUSTMENT DEVICE

BACKGROUND OF THE INVENTION

The invention relates to camshaft adjustment device for the adjustment of a phase position of a camshaft relative to a crankshaft of an internal combustion engine which includes a hydraulic system for supplying hydraulic operating fluid to the operating chambers of the camshaft adjustment device.

Adjustment devices for controlling the phase position of a camshaft relative to a crankshaft of an internal combustion engine often employ a hydraulic operating mechanism including vanes mounted on a first body which is rotatable with the camshaft and a second body which receives the first body so as to be rotatable therein and is provided with counter vanes. The two bodies form between the vanes operating chambers to which hydraulic operating fluid can be supplied. An adjustment of the hydraulic cam adjuster results normally in a pressure drop in the oil supply to the camshaft adjuster. Consequently, at low engine speed and hot engine, operation of the camshaft adjuster may result in an undesirable oil pressure drop below the required minimum pressure of the engine. As a result, for example, the camshaft bearings may wear excessively the engine life may be shortened.

In order to avoid such an oil pressure drop, a larger oil pump may for example be used. This however increases the power consumption of accessory device and consequently the fuel consumption for a motor vehicle with the same driving performance. Alternatively, pressure stores may be used which, however, require a larger space which is generally not available. Novel camshaft adjuster includes a hydraulic circuit via which the actuation of the angular adjustment occurs passively by a camshaft torque changing over a shaft rotation one or several times. Such camshaft adjusts provide on the basis of inertia however only a passive "adjustment function" up to a certain maximum limit speed above which no adjustment is possible. The necessary adjustment speed however becomes continuously smaller with increasing rotational speed already below this limit speed.

For some time now, embodiments of adjusters are known which utilize the varying torque of the camshaft for enhancing the adjustment by hydraulic fluid or oil pressure. These adjusters require as additional design component a check valve which is arranged in the oil supply path ahead of a proportional valve which is needed for the control. By this check valve, a back flow of oil into the engine oil circuit caused by the counteraction of the camshaft torque against the desired adjustment direction is prevented. If the effective direction of the camshaft torque corresponds to the desired adjustment direction the camshaft adjuster acts like a pump and sucks oil out of the engine oil circuit into the adjuster. Particularly with high adjustment speeds, this may result in a drop of the engine oil pressure which, at low engine speeds and hot engine oil, may drop below the limit values.

Furthermore, the varying torque of the adjuster may be used as driving means. To this end, the outlet of the chamber disposed in adjustment direction must be connected with the supply to the counter chamber. To ensure that only the part of the camshaft torque is used which acts in the adjustment direction, the flow direction of the oil must be determined by the control arrangement. This can be ensured by the check valve. An adjuster operating with this operating principle requires from the engine oil circuit the lubricant only once for the filling of the adjustment chambers, as well as some oil for the continuous replacement of leakage oil so that no oil pressure drop occurs during the adjustment procedure. However with this adjustment principle, the adjustment dynamics drops continuously with increasing rotational speeds. Beginning at a certain maximum speed an adjustment is no longer possible.

A hydraulic camshaft adjuster based on a vane structure is known from EP 4 073 830 A1.

In hot arrangement, the oil needed for the adjustment of the camshaft is taken from the camshaft via a control valve disposed at a hydraulically suitable location in a central mounting bolt. The adjuster can be operated also at relatively low oil pressures because the pressure losses are minimized by short control lines, although a certain pressure drop is unavoidable.

U.S. Pat. No. 5,107,804 discloses a passive camshaft adjuster which, in addition to a check valve in the oil supply line, includes a check valve in the oil supply from the control valve to each hydraulic operating chamber of the adjuster. This increases the number of components and, with more than two operating chambers, requires the provision of expensive oil channels and increases the manufacturing expenses. An adjustment at higher engine speeds is possible with this circuit only in a limited way because of the mechanical inertia.

DE 42 29 201 C2 discloses a camshaft adjuster whose hydraulic circuit includes a control valve by which the oil return flow is conducted from the camshaft retarding operating chambers selectively to the operating chambers which advance the camshaft or to the tank. In this way, the adjuster can be switched by electromagnetic actuation from a "passive adjustment" by means of camshaft torques to an active adjustment by means of oil pressure. However, the additional valve with a separate electrical switching operation is disadvantageous as the adjuster and the respective motor control becomes more complicated and expensive.

Furthermore, EP 1 221 540 A1 discloses a camshaft adjuster with reduced control expenditures. This reduction is achieved by the replacement of magnetic actuation by an oil pressure or centrifugal force actuation of the switch-over valve for the particular operation. The hydraulic actuation however requires a larger space because of the presence of a control valve, check valves and a switch-over valve in the camshaft adjuster.

It is the object of the present invention to provide a camshaft adjustment device for the phase adjustment of a camshaft relative to a crankshaft of an internal combustion engine which provides for optimal adjustment functions also at low oil pressure levels and, which, at the same time, is of compact design.

SUMMARY OF THE INVENTION

In an adjustment device for adjusting the phase position of a camshaft relative to a crankshaft of an internal combustion engine which includes a hydraulic system for supplying hydraulic fluid under pressure to the adjustment device for the controlled admission to, and release thereof from, operating chambers of the adjustment device under the control of a control device including a control valve, the operating chambers are in communication with one another via control valves to permit flow of hydraulic fluid from one set of operating chambers to another by the varying torques effective on the camshaft or by controlling fluid supply to the operating chambers from the hydraulic fluid supply system.

Advantageously, the adjustment device according to the invention does not experience, in the whole operating range, any oil pressure drop which may be detrimental for the engine lubrication since the actuation of the adjustment device always occurs during an operational mode of the engine which is most advantageous for the engine. At low oil pressure, a passive adjustment occurs, that is, the operation of the adjustment device is provided by the camshaft torque caused by the controlled displacement of the oil out of the operating chambers which are becoming smaller into chambers which are becoming larger. At high oil pressures, an active adjustment is implemented, that is, adjustment operation is obtained directly by the oil pressure. If the check valves and or the control valves are advantageously integrated into the adjuster, a particularly compact embodiment of the adjuster is obtained. Especially advantageous in this connection is an embodiment wherein at least the check valves required for the switching over are integrated into the valve housing.

Another advantage, particularly with respect to a fast adjustment at low oil temperatures and, at the same time, a compact design of the device is obtained if the hydraulic circuit includes a control valve with a control slide member integrated into the central mounting bolt of the adjustment device onto the driven shaft, and, at the same time, one or several check valves of the hydraulic circuit are also arranged within, or at, the central mounting bolt. This makes a particularly cost-effective and simple manufacture possible and facilitates the assembly of the adjustment device according to the invention.

The invention and further advantages thereof will become more readily apparent from the following description of particular embodiments thereof on the basis of the accompanying drawings.

DETAILED DESCRIPTION OF VARIOUS EMBODIMENTS

Figure 1:
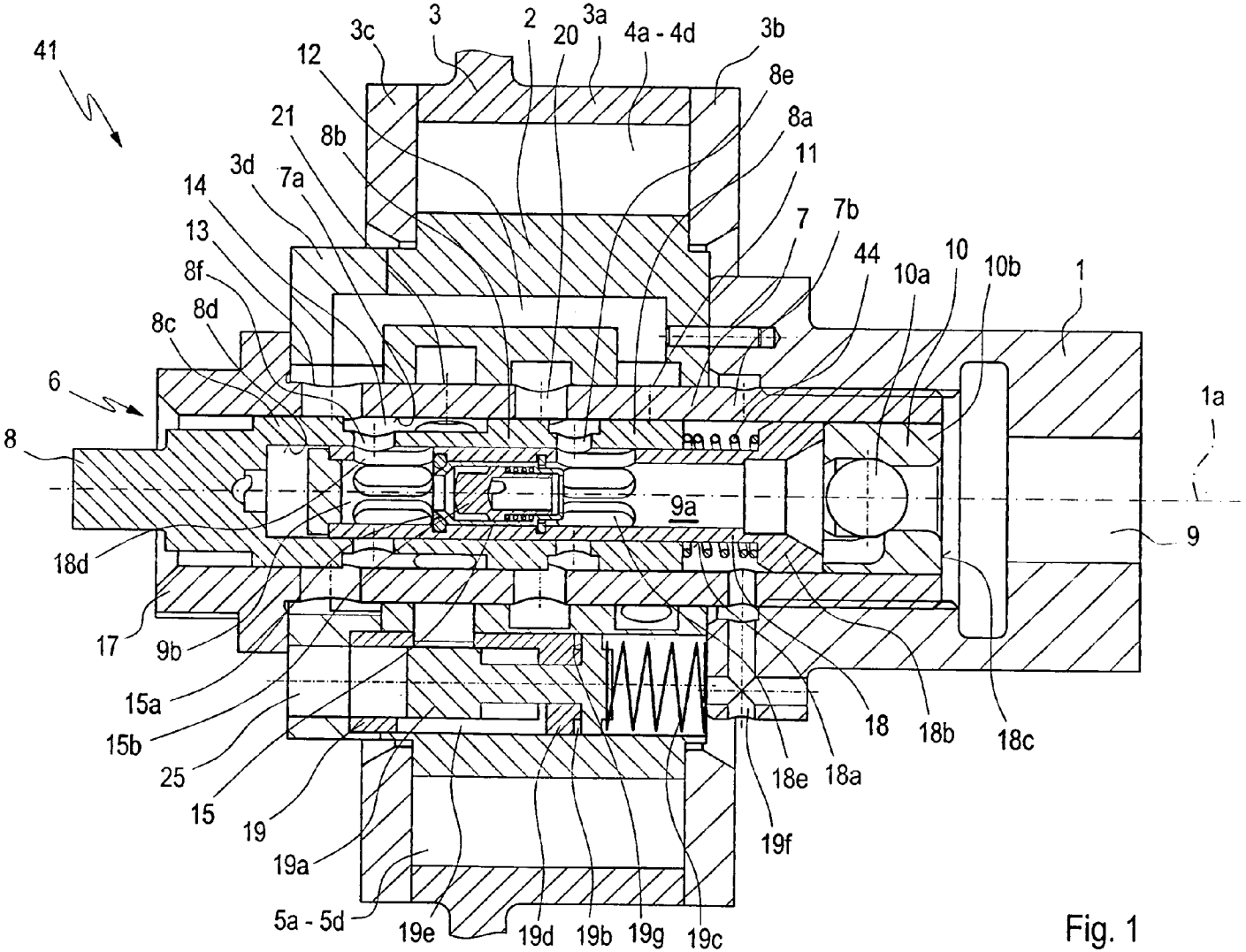
FIG. 1 is a longitudinal cross-sectional view of an adjustment device according to the invention for the phase adjustment of a camshaft with respect to a crankshaft of an internal combustion engine with two check valves and a serial-control-valve for switching the mode of operation to an advancing control position wherein the switch-over valve is closed.

FIGS. 1 to 10 show an embodiment of an adjustment device according to the present invention for the adjustment of a phase position of a camshaft 1 with respect to a crankshaft of an internal combustion engine in different settings. The adjustment device is disposed in the drive train of a camshaft 1 driven by a crankshaft which is not shown in the drawings. The adjustment device is supplied with hydraulic fluid by the hydraulic system of an internal combustion engine in which the adjustment device is installed.

Figure 7:
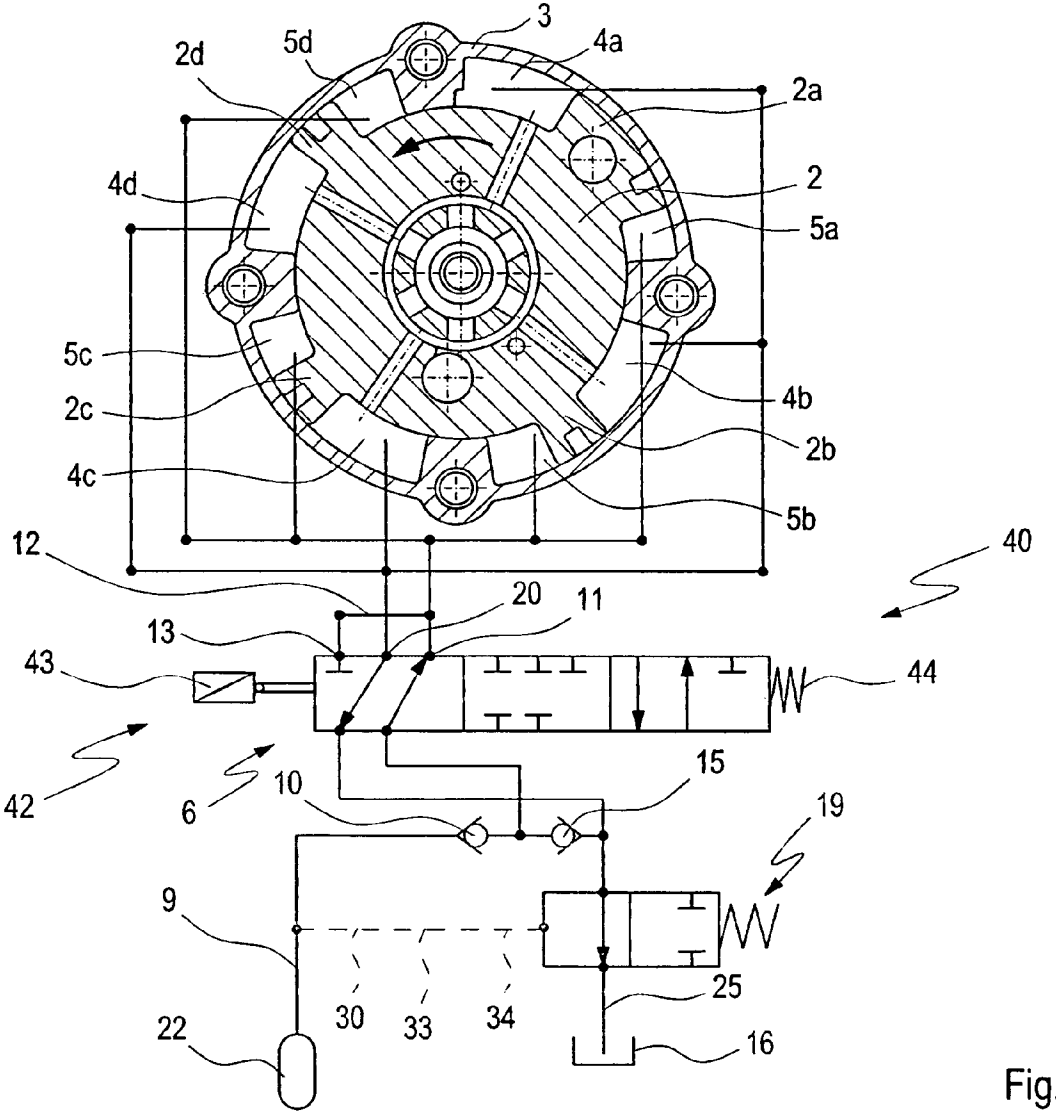
FIG. 7 shows the adjustment device in a retarding control position with the serial valve closed and also the associated control circuit.

For adjusting the phase position or changing the phase position, the adjustment device includes a first inner body 2, which is mounted for rotation with the camshaft 1, and a second outer body 3 which is rotatably supported relative to the first body 2. Around the second body 3 extends a drive connection (not shown) to the crankshaft of the engine such as a drive chain. The second body 3 comprises several body parts 3*a* to 3*d*. The two bodies 2 and 3 together form groups of operating chambers 4*a* to 4*d* and 5*a* to 5*d*. Hydraulic fluid is supplied to the operating chambers 4*a* to 4*d* and 5*a* to 5*d*, or is released therefrom, under control of a control arrangement which includes a control valve 6. The control valve 6 includes a control spool 8 which can be operated by an actuating magnet 43 against the force of a valve spring 44 (FIG. 7). The valve housing 7 can be mounted in the camshaft 1 by screwing, pressing, cementing soldering or welding. The pressurized oil flows via an oil supply passage 9 from the camshaft 1 to the control valve 6. The pressurized oil supply channel 9 includes a first check valve 10, which, in the embodiment shown, consists of a valve ball 10*a* and a valve seat 10*b*.

Preferably, a 5/3 way proportional valve is used as the control valve 6 and one of the groups of operating chambers 4*a* to 4*d* or 5*a* to 5*d* includes, in addition to an oil supply connection 11, a release channel 12 extending to another connection 13 of the control valve 6. This release channel 12 extends within the control valve 6 via a return channel 14 of the respective other operating chambers 5*a* to 5*d* or 4*a* to 4*d* to a second check valve 15 in such a way that, with the discharge of oil from the chambers 5*a* to 5*d* or 4*a* to 4*d* which are becoming smaller oil is supplied to the operating chambers 4*a* to 4*d* or 5*a* to 5*d* while the flow in the opposite direction is blocked. Vice versa, the return flow of oil from the chambers 4*a* to 4*d* is unblocked while flow in the opposite direction is blocked. The flow from one operating chambers 5*a* to 5*d* or 4*a* to 4*d* is unblocked always only by the second check valve 15, or, respectively, blocked in the opposite direction. Therefore the two check valves 10 and 15 can be designed for very different flow and pressure requirements. The hydraulic system does not provide uncontrolled communication with the tank 16 in any position of the control spool 8.

Figure 18:
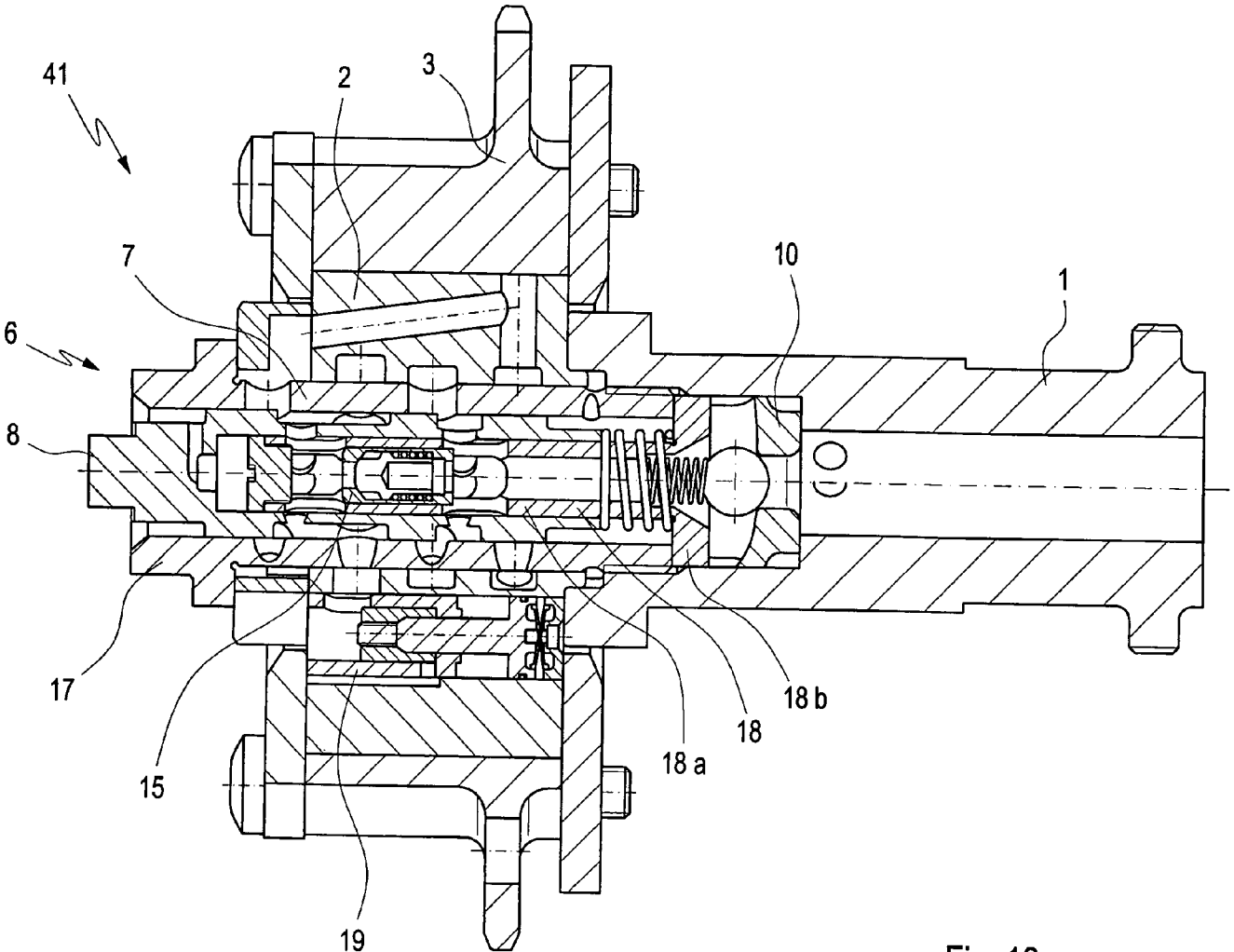
FIG. 18 shows an adjustment device wherein an inner sleeve of a control valve is attached to the camshaft.
Figure 19:
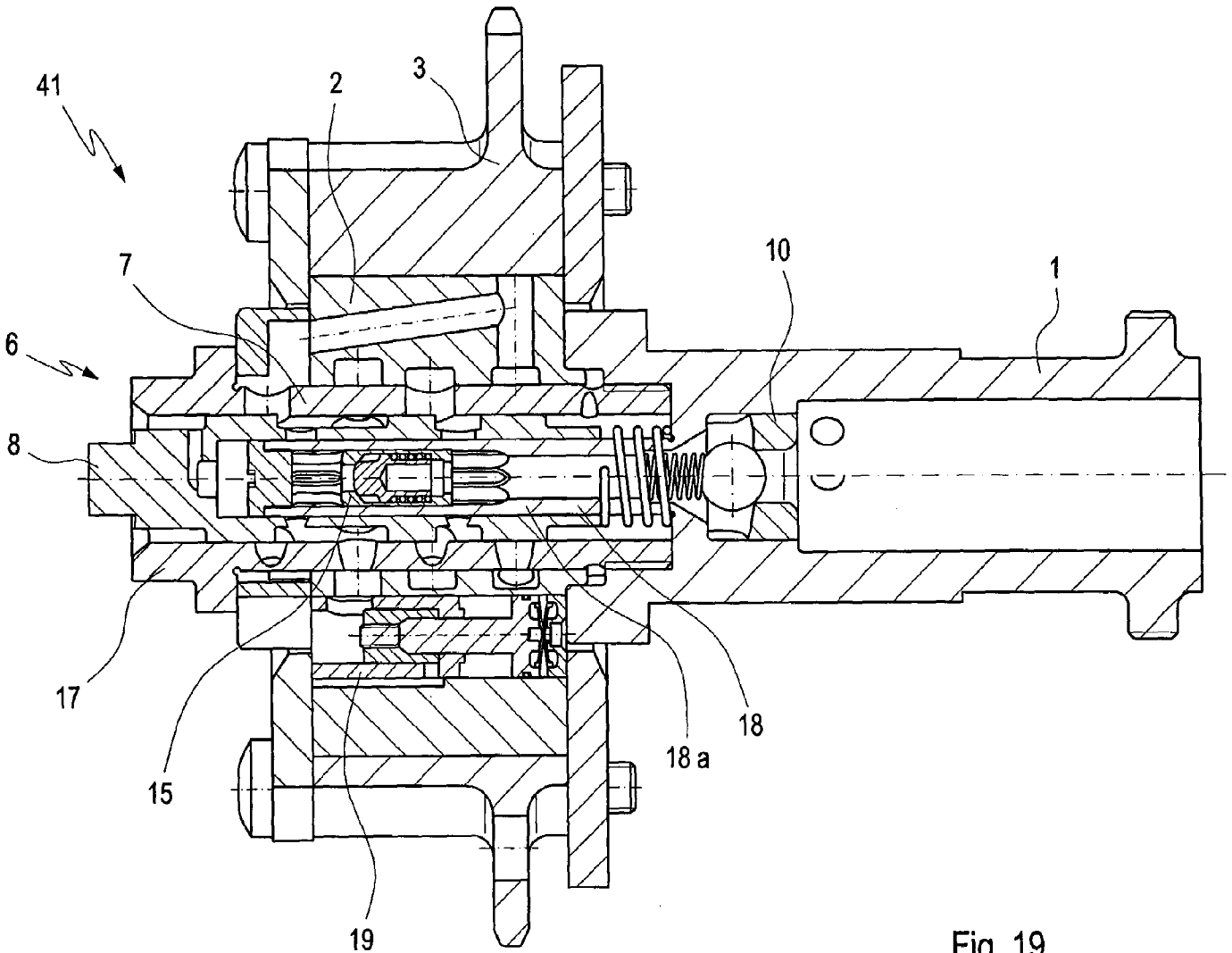
FIG. 19 shows an adjustment device wherein the inner sleeve of the control valve is formed integrally with the camshaft.

At least one, but also both, of the check valves 10 or, respectively, 15 may be integrated into the control valve 6 or arranged at the control valve 6. The second check valve 15 may be arranged in a space-saving manner within the control piston 8 or at the control piston 8. The control valve 6 may be arranged together with the check valves 10 and 15 in a central mounting bolt 17 by which the camshaft adjuster is mounted onto the camshaft 1 which provides for a particularly compact arrangement. In the embodiment shown, the valve housing 7 is formed by at least one, preferably hollow-cylindrical, partial section 7*b* of the central mounting bolt 17. The control piston 8 has at least partially the form of a hollow cylinder with circumferential outer webs 8*a* and is axially slideably supported with its outer circumference on the hollow cylindrical inner wall 7*a* of the valve housing 7. The inner wall 8*b* of the control piston 8 is axially movably supported on the inner surface 18*a* of a hollow cylindrical sleeve 18 which, via a sleeve shoulder 18*b*, is firmly connected to the inner wall 7*a* of the valve housing. Alternatively, the inner sleeve 18 of the control valve 6 may—as shown in FIG. 18—be attached to the camshaft or, as shown in FIG. 19, it may be formed integrally with the camshaft 1, that is, it may form a single piece with the camshaft. The sleeve shoulder 18*b* forms, at its axial end surface 18*c* remote from the control piston 8, a limiting stop for the valve body 10*a* of the first check valve 10. In the present embodiment, the second check valve 15 is disposed in the inner sleeve 18 associated with the valve housing 7 of the control valve 6 and the first check valve 10 is arranged directly in the valve housing 7.

In the embodiment as shown in the FIGS 1 to 10, the control valve 6 forms—depending on the various axial positions of the control piston 8—with its annular webs 8*a* to 8*c* in cooperation with the radial connecting openings 11, 13, 20 and 21 in the valve housing 7, the radial passages 18*d*, 18*e*, and the inner sleeve 18 and the discharge channel 12 in the first body of the control device connected to the camshaft 1, various control states, in which the control device rotates the driven camshaft 1 with respect to the driving crankshaft (which is not shown) to an advancing or a retarding position or holds it in an intermediate position. An additional serial valve 19, preferably an oil pressure actuated 2/2 way control valve, provides for a switch-over between a passive mode of operation wherein the adjustment device is operated by the changing torque effective on the driven camshaft 1 and an active mode of operation of the camshaft adjuster wherein the adjuster is hydraulically actively operated by the pressurized oil from the hydraulic source 22.

Figure 2:
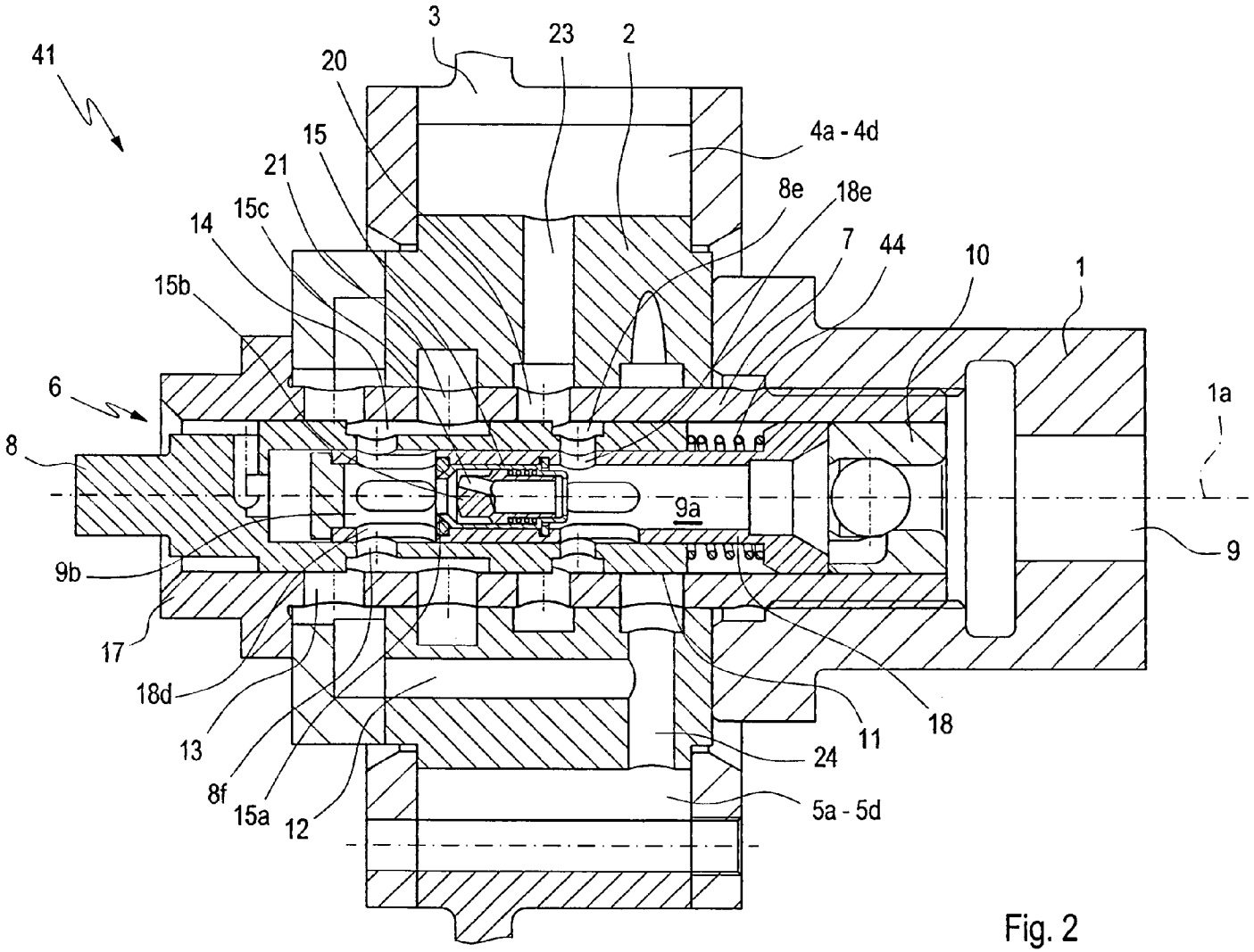
FIG. 2 shows the adjustment device according to FIG. 1 in a longitudinal cross-sectional view showing the oil passages between the control valve and the operating chambers.
Figure 3:
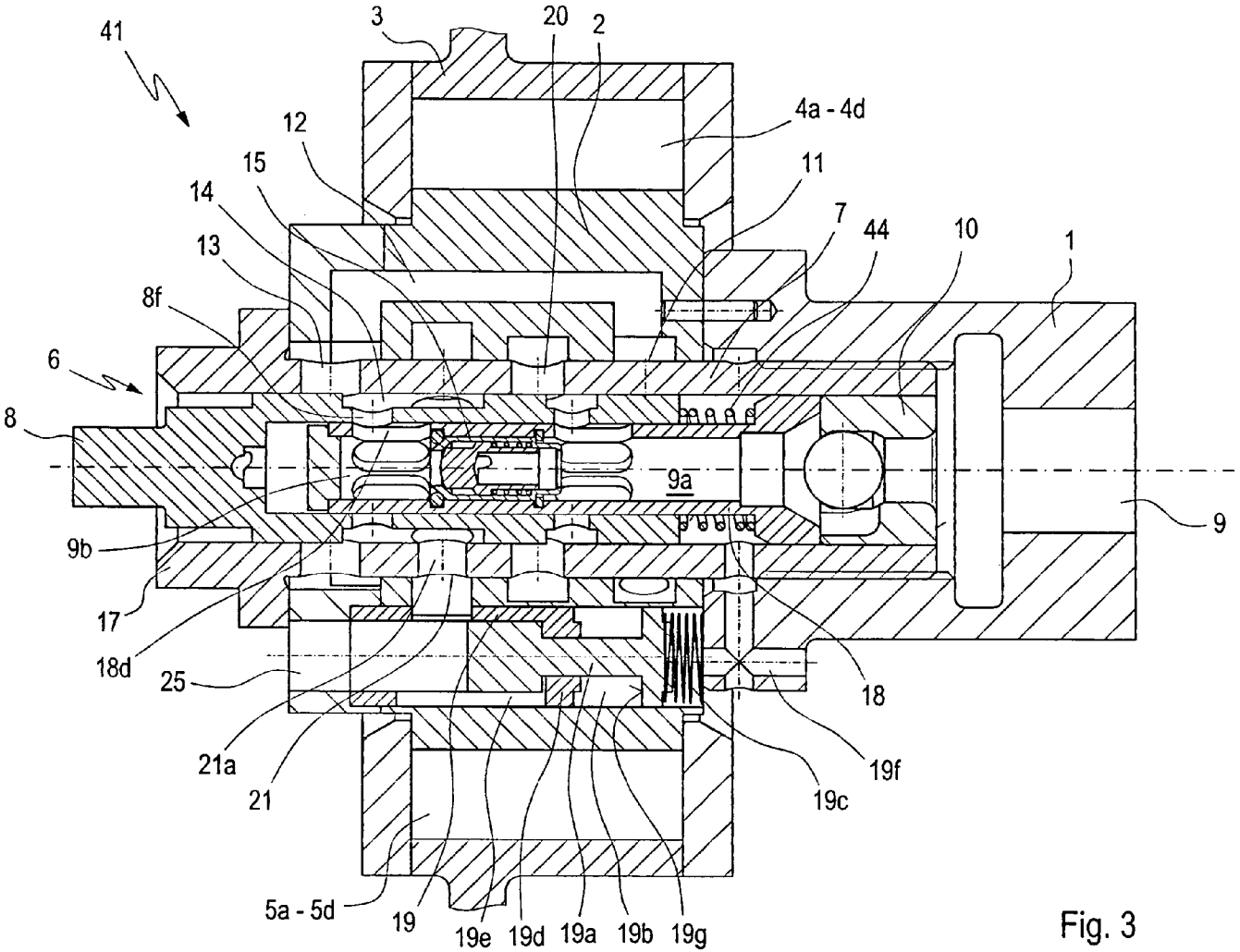
FIG. 3 shows in a longitudinal cross-sectional view, the adjustment device in an advancing control position with the serial control valve open.
Figure 4:
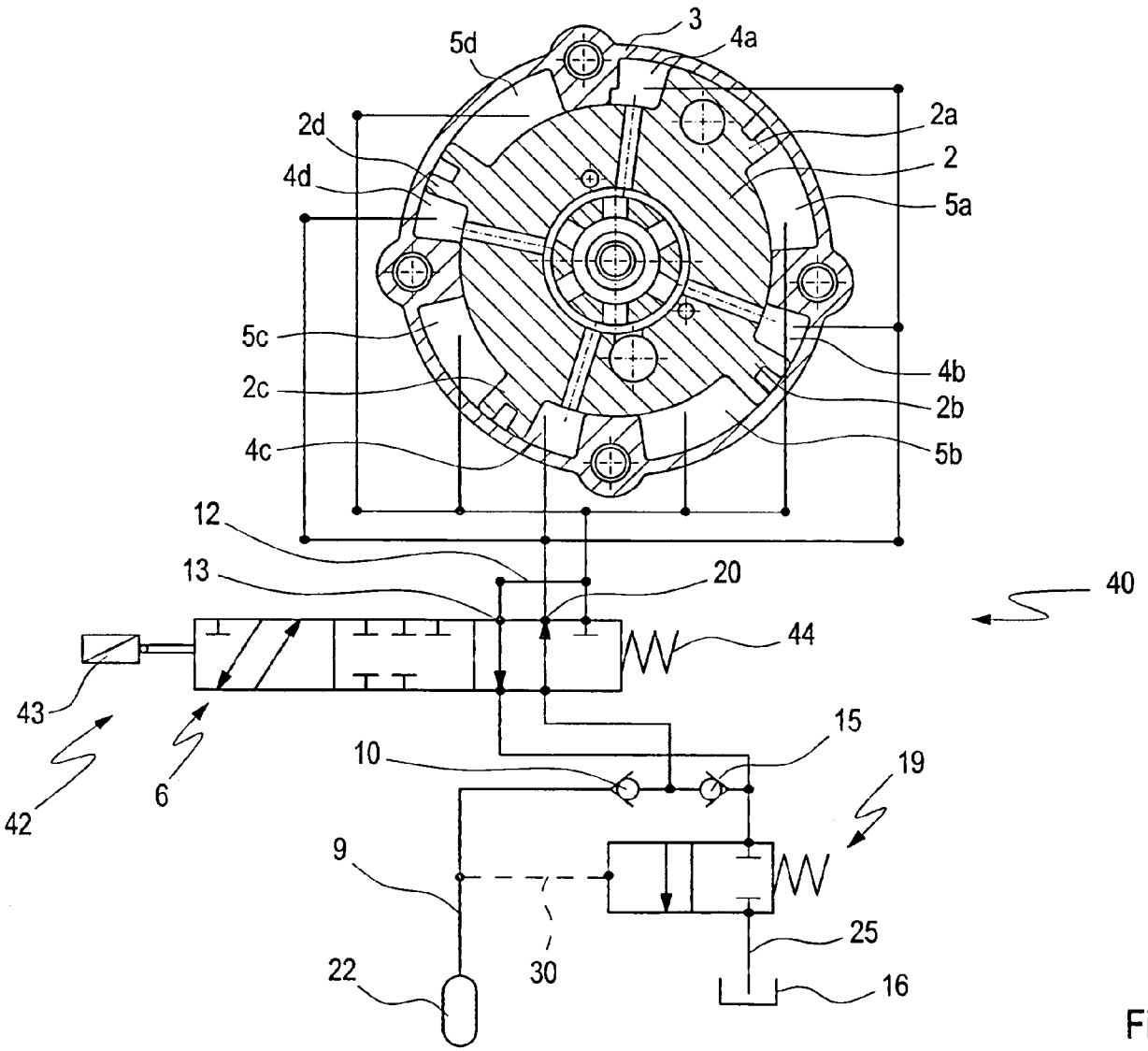
FIG. 4 is a transverse cross-sectional view of the adjustment device of FIG. 2 with an associated hydraulic control circuit.
Figure 20:
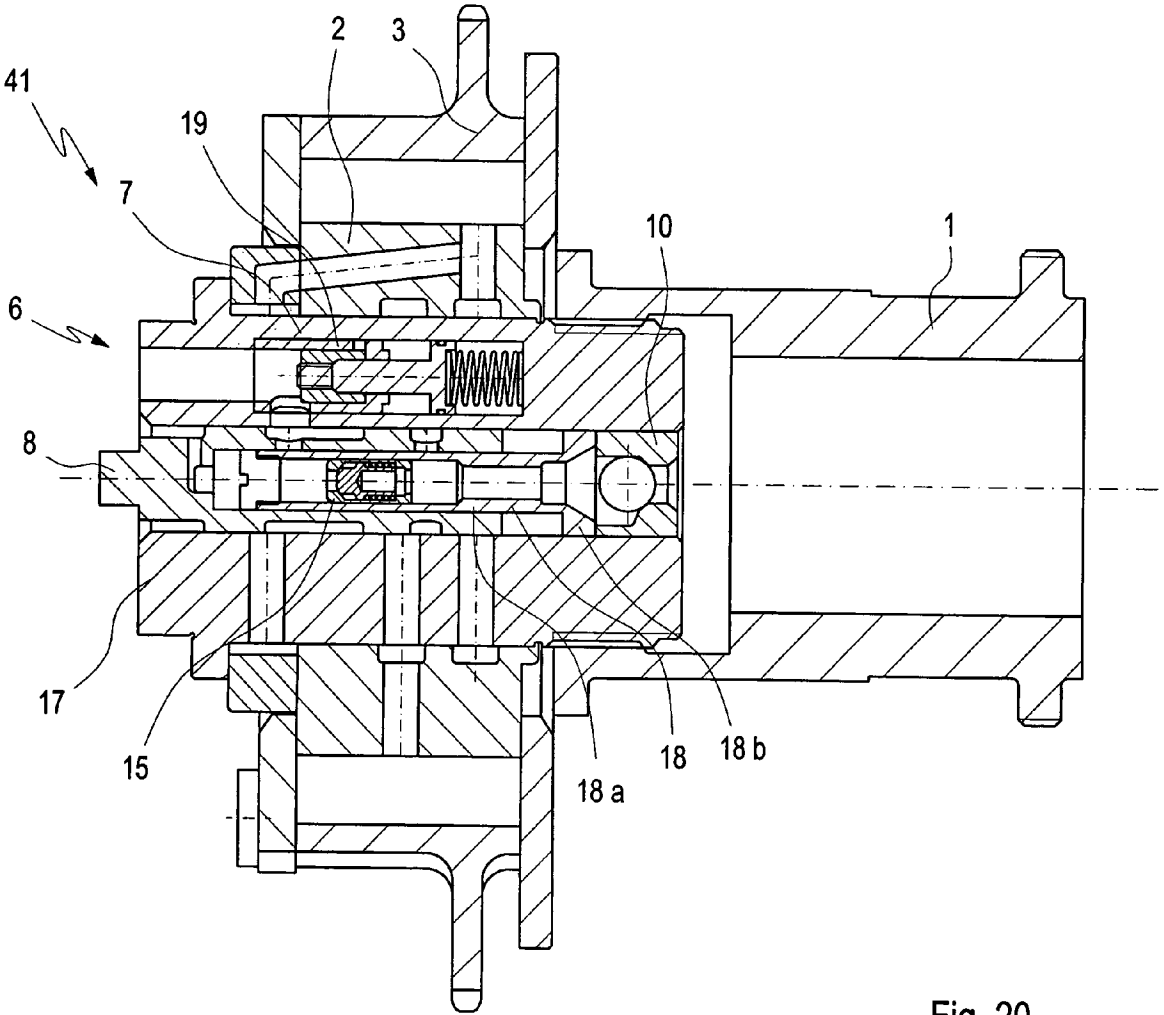
FIG. 20 shows an adjustment device wherein the serial valve is arranged within a mounting bolt.

The FIGS. 1 to 4 show the adjustment device in an advancing control state wherein each of FIGS. 1 and 3 show the adjustment device in an axial cross-sectional view. It is apparent therefrom that a serial valve 19 is arranged, preferably, within the first body 2 connected to the camshaft 1 for rotation therewith and oriented so that the axis of movement of the serial valve extends parallel to the axis of rotation of the adjustment device or respectively, the camshaft. Alternatively, the serial valve 19 may be disposed within, or at, the mounting bolt 17 for mounting the adjustment device to the camshaft 1 as shown in FIG. 20 or also within the valve housing 7 or at the valve housing 7. FIG. 4 shows the preferred control arrangement in a cross-sectional view wherein the hydraulic function in the form of the associated hydraulic control scheme is shown. FIG. 2 shows the preferred adjustment device with the oil passages established by the control valve 6 between the chambers 4*a* to 4*d* and 5*a* to 5*d* with the serial valve 19 closed, wherein a passive operational mode of the adjustment device is established. In this state, the control piston 8 of the control valve 6 establishes in the shown axial position, via the radial opening 18*e* in the inner sleeve 18 and the radial opening 8*e* in the hollow cylindrical control piston 8 and the discharge opening 20 in the valve housing 7, a passage from the operating medium-filled interior 9*a* of the inner sleeve 18 via at least one radial channel 23 in the inner body 2 of the adjustment device to the chambers 4*a* to 4*d*. At the same time, in this axial position of the control piston 8, a communication path from the chambers 5*a* to 5*d* via at least one radial channel 24 and the discharge channel 12 to the connection 13 at the valve housing and from there, via the radial openings 8*f* in the control piston 8 and 18*d* in the cylinder head wall of the inner sleeve to the inner space 9*b* of the inner sleeve is established. In this way, the valve body 15*b* of the second check valve 15 opens the oil passage from the inner space 9*b* via the bore 15*c* in the valve body 15*b* to the inner space 9*a* of the inner sleeve 18 and blocks it in the opposite direction.

If, during a revolution of the camshaft 1 about its axis of rotation 1*a*, at least for a short period a camshaft torque is present which, as a result of the hydraulic support of the camshaft 1 by way of the inner body 2 with its vanes 2*a* to 2*d* on the oil volume of the chambers 5*a* to 5*d*, increases the pressure in these chambers 5*a* to 5*d* over that in the chambers 4*a* to 4*d*, the oil of the chambers 5*a* to 5*d* can flow, via the communication channel described, to the inner space 9*b* of the inner sleeve 18 and, via the second check valve 15, into the inner space 9*a* and to the chambers 4*a* to 4*d* in which, at the same time, the pressure is lower. This results in an advance movement of the camshaft. In this way, the adjustment device can increase the oil volume of the chambers 4*a* to 4*d* by the volume displaced from the chambers 5*a* to 5*d* without the need for an oil supply from the pressurized oil supply 22 via the pressurized oil supply passage 9 and the first check valve 10 to the adjustment device. The oil flow from the last mentioned oil supply 22 then serves only as compensation means for outer leakages of the adjustment device. The hydraulic circuit described ensures even with a closed serial valve 19 a rotation of the camshaft 1 with respect to the driving crankshaft solely by means of the torque variations effective between the camshaft 1 and the adjustment device.

In accordance with FIG. 3, the serial valve 19 for determining the mode of operation of the adjustment device can be moved by applying oil pressure to the valve piston 19*a* from the oil in the pressure space 19*b* to move the valve piston 19*a* against the force of the compression spring 19*c* from the closed position to an open position. The hydraulic control force is generated by the effect of the oil pressure on the piston surface 19*g* via the pressure support against the separation web 19*d*, whereby the movement of the valve piston 19*a* is facilitated by the venting channels 19*c* and 19*f* at the serial valve 19. With the movement of the valve piston 19*a* into the shown open position, the chambers 5*a* to 5*d* are placed, in the shown axial position of the control piston 8, next to the already described channel to the connection 13 at the control valve 6 and from there, via the oil return channel 14 and the radial channel 21*a* at the connection 21 of the control valve 6, into communication with the discharge opening 25 to the tank 16. In this process, the adjustment device is switched from the passive mode of operation with the serial valve 19 closed to a hydraulically active mode of operation in which the serial valve 19 is open. As a result, the relative adjustment of the camshaft 1 with respect to the driving crankshaft into an advanced angular position occurs with the aid of the pressure difference at the radial vanes 2*a* to 2*d* of the inner part 2 between the chambers 4*a* to 4*d*, pressurized by the hydraulic pressure source 22 and the chambers 5*a* to 5*d* placed into communication with the oil storage tank T.

Figure 5:
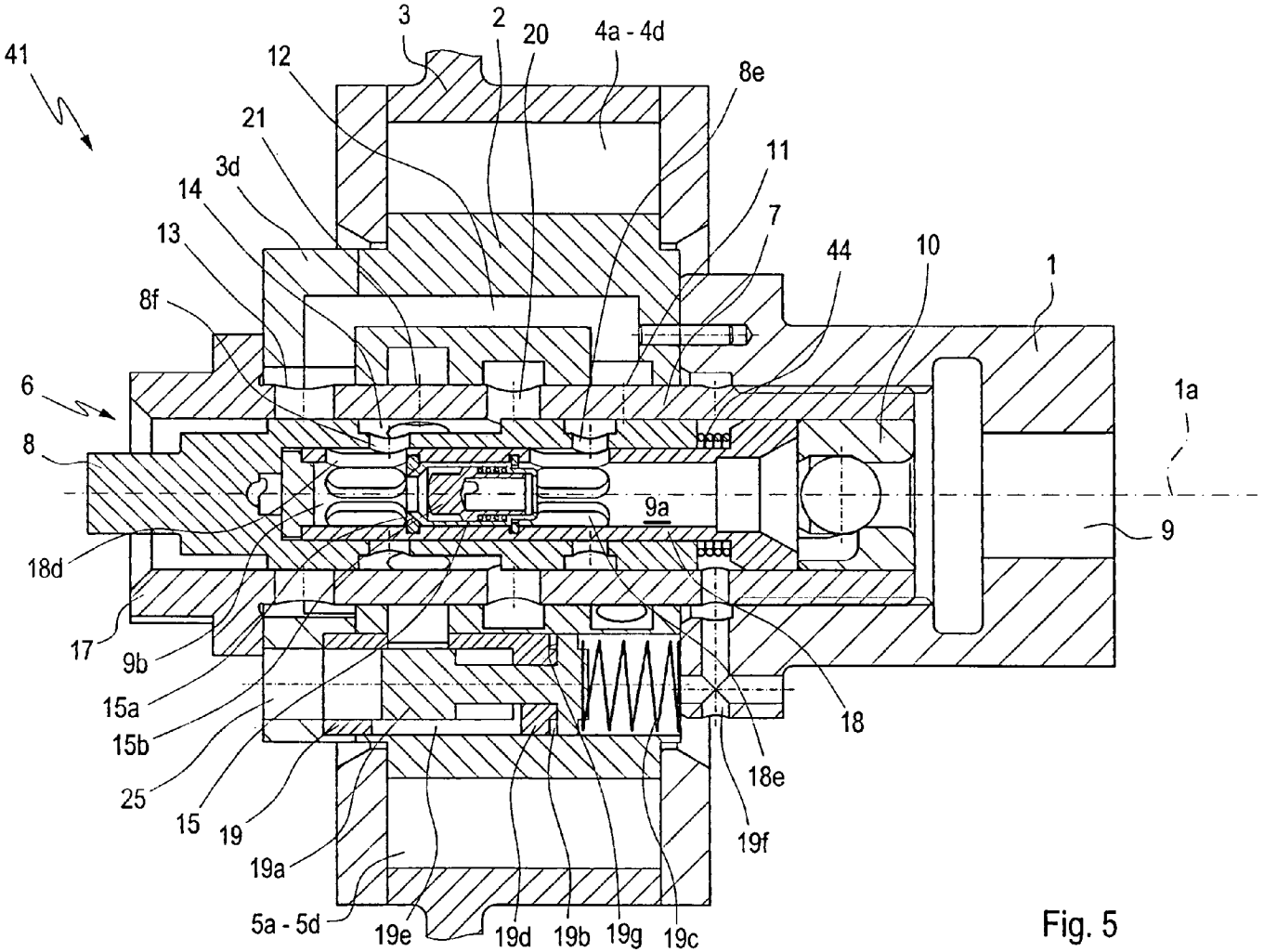
FIG. 5 shows the adjustment device in a longitudinal cross-sectional view in a retarding control position with the serial control valve closed.
Figure 6:
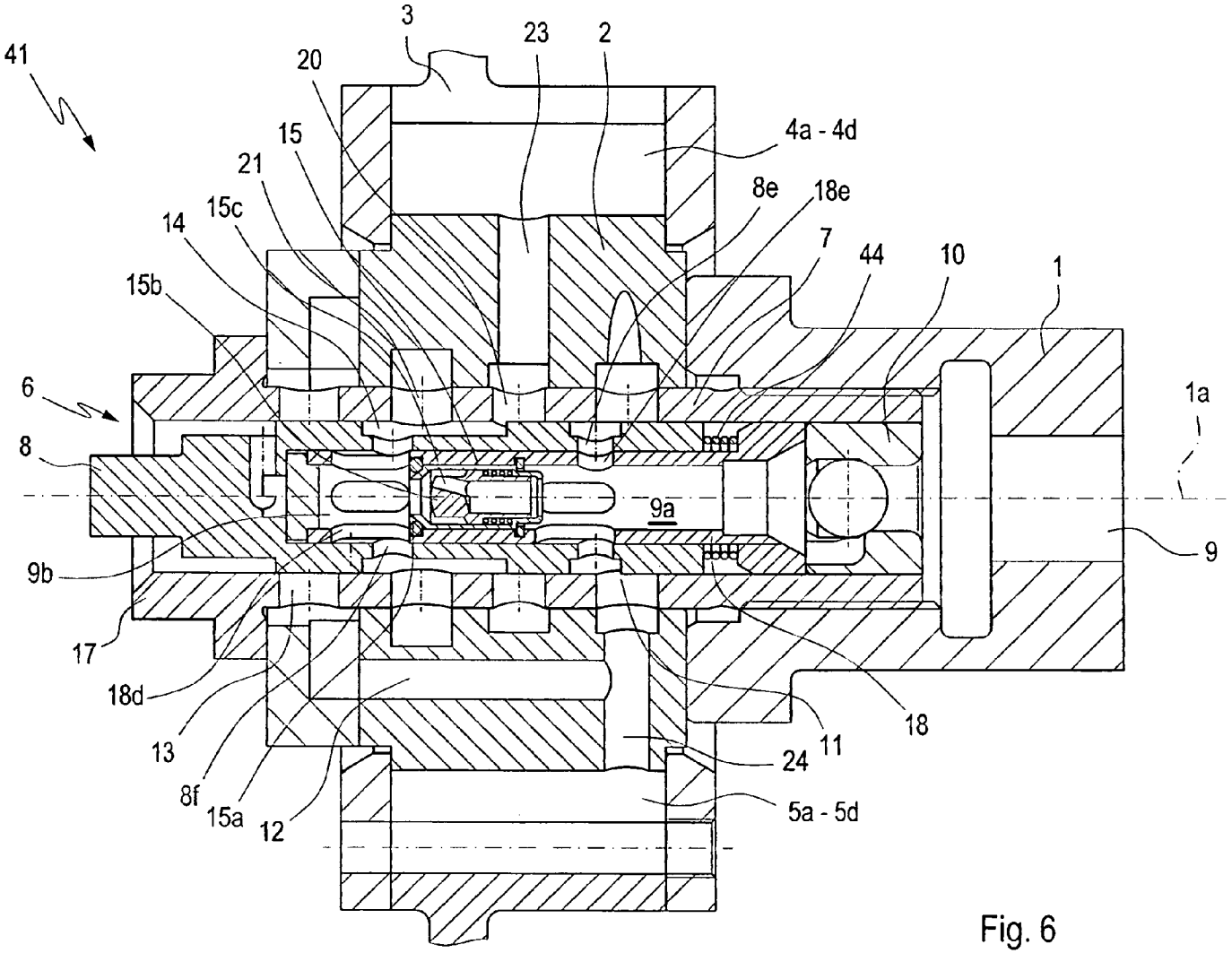
FIG. 6 shows the arrangement according to FIG. 5 in a longitudinal cross-sectional view highlighting the oil passage between the control valve and the operating chambers.

FIGS. 5 to 8 show the adjustment device in a retarding control state. FIG. 5 shows an axial cross-section of the adjustment device with the series valve 19 in a closed position. The series valve 19 is preferably arranged in the first body 2 which is mounted for rotation with the camshaft 1 and arranged with the axis of movement of the serial valve extending parallel to the axis of rotation of the adjustment device or, respectively, the camshaft 1. FIG. 6 shows the oil flow paths formed between the chambers 4*a*-4*d* and 5*a*-5*d* with the serial valve 19 closed. FIG. 7 shows the preferred adjustment device according to FIG. 5 in a transverse cross-sectional view wherein the hydraulic functions are shown in the form of a respective hydraulic circuit. When the serial valve 19 is closed, the adjustment device operates in a passive mode. In that case, the control piston 8 of the control valve 6 provides, in the axial position shown, by way of the radial opening 18*e* in the inner sleeve 18 and the radial opening 83 in the hollow cylindrical control piston 8 and the connecting opening 11 in the valve housing 7, for a passage from the medium-filled inner space 9*a* of the inner sleeve 18 via at least one radial channel 24 in the inner body 2 of the adjustment device to the retardation chambers 5*a* to 5*d*. At the same time, in this axial position of the control piston 8, a communication path is provided from the advancement chambers 4*a* to 4*d*, by way of at least one radial channel 23 to the connection 20 at the valve housing and from the valve housing by way of a return channel 14 and the radial openings 8*f* in the control piston 8 and 18*d* in the cylindrical wall of the inner sleeve 18 up to the interior space 9*b* of the inner sleeve. The valve body 15*b* of the second check valve 15 opens the oil passage from the inner space 9*b* by way of the bore 15*c* in the valve body 15*b* to the inner space 9*a* of the inner sleeve 18 and closes it in the opposite direction.

If, during a revolution of the camshaft 1 about its axis of rotation 1*a*, at least for a short period a camshaft torque is present which, because of the hydraulic support of the camshaft 1 via the inner body 2 with its projecting vanes 2*a* to 2*d* on the oil volume in the chambers 4*a* to 4*d*, increases the pressure in the chambers 5*a* to 5*d*, the oil of the chambers 4*a* to 4*d* can flow via the described connecting channels to the interior space 9*b* of the inner sleeve 18 and then, via the second check valve 15, which opens in the direction toward the inner space 9*a*, to the interior space 9*a* via the connecting channel described, to the interior space 9*a* via the connecting channel described to the chambers 5*a* to 5*d* in which the fluid pressure is at the same time lower. In this way, the adjustment device, can increase the oil volume in the advancing chambers 5*a* to 5*d* by the amount displaced from the retarding chambers 4*a* to 4*d*, without the need for an oil supply from the pressurized fluid supply 22 via the pressurized oil supply channel 9 and the first check valve 10 in the adjustment direction. The oil flow from the pressurized oil supply serves exclusively as compensation for leakage losses of the adjustment device. With the serial valve closed, the hydraulic circuit described herein ensures a rotation of the camshaft 1 with respect of the driving camshaft only by the torque changes of the camshaft effective on the adjustment device.

Figure 8:
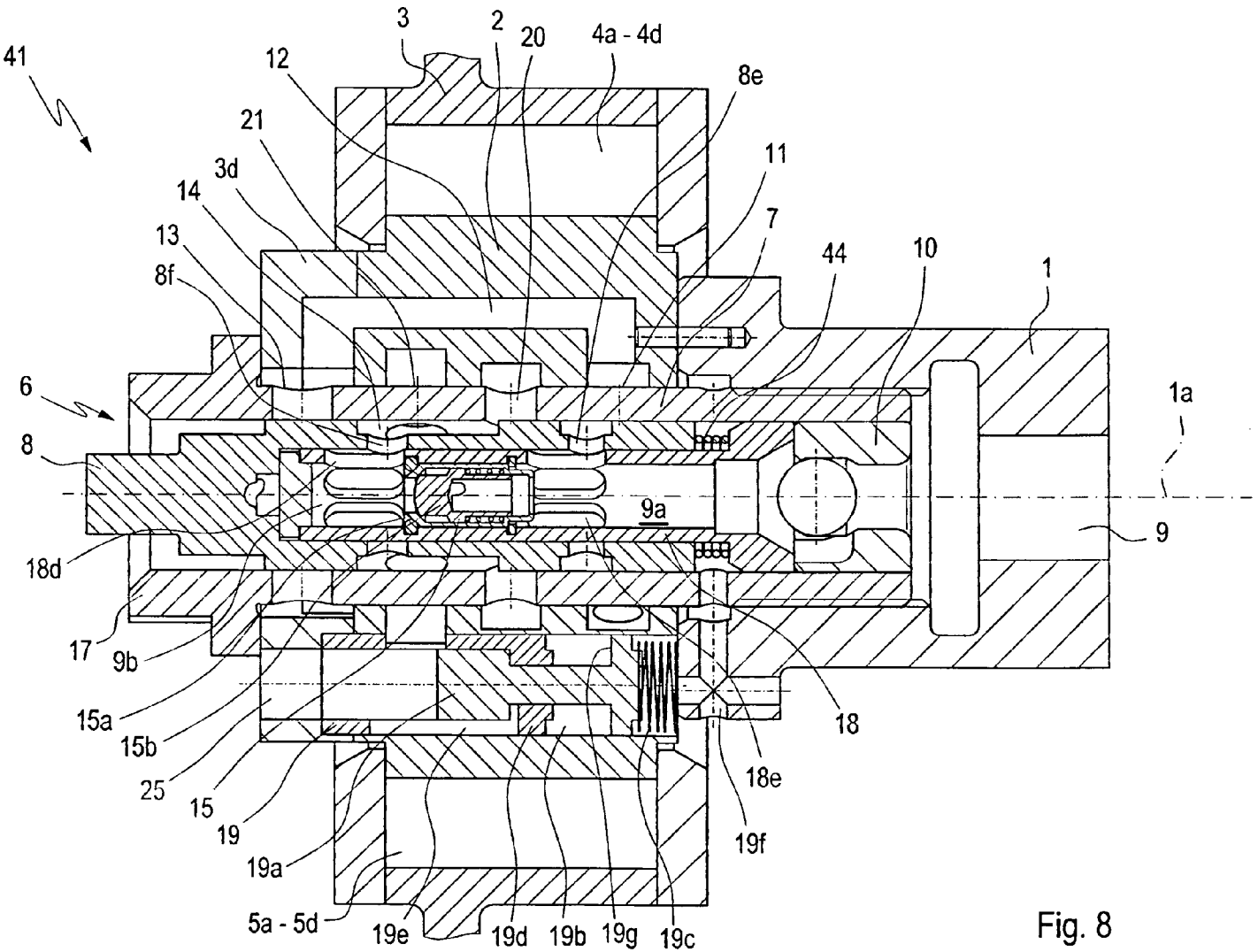
FIG. 8 shows the adjustment device in a longitudinal cross-sectional view in a retarding control position with the serial valve open.

In a retarding position of the control valve 6 according to FIGS. 7 and 8, the operating mode of the adjustment device can be switched from a hydraulic passive to an active mode of operation. By the movement of the valve piston 19*a* to the shown open position, the chambers 4*a* to 4*d* are placed in the shown axial position of the control piston 8 next to the already described channel to the connection 20 at the control valve 6 from here via the return channel 14 and the radial channel 21*a* at the connection 21 of the control valve 6 into communication with the discharge control valve opening 25 leading to the tank 16. In this way, the adjustment device is changed over from a passive operating mode in which the serial valve 10 is closed to a hydraulically active operating mode in which the serial valve is switched to the open position. As a result, the adjustment of the camshaft 1 relative to the driving crankshaft to a retarding position is achieved by the utilization of the pressure difference at the radial vanes 2*a* to 2*d* of the inner part 2 between the chambers 5*a* to 5*b* which are pressurized by the pressure source 22 and the chambers 4*a* to 4*d* which are placed into communication with the tank 16.

Figure 9:
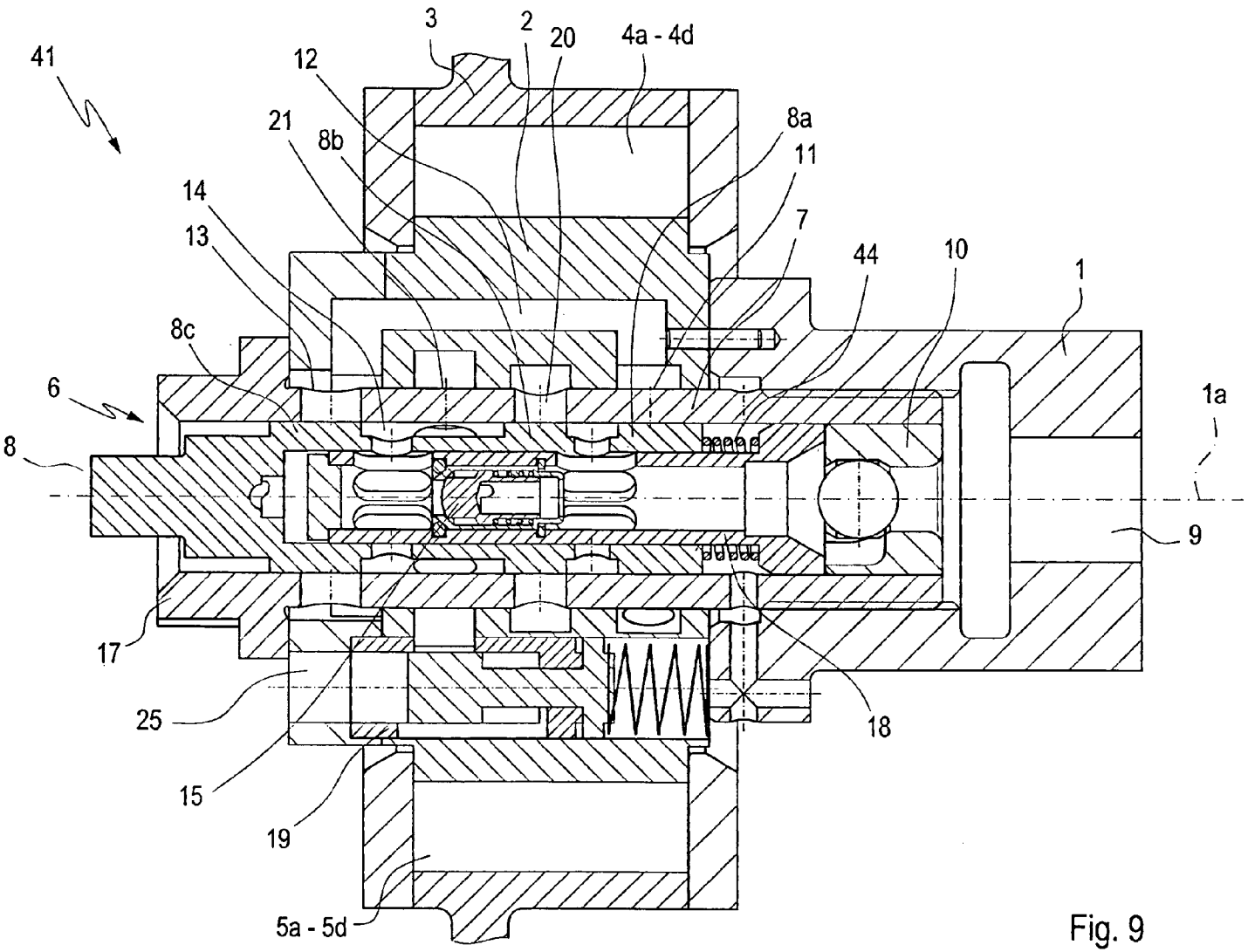
FIG. 9 shows the adjustment device in a longitudinal cross-sectional view in a neutral intermediate position with the serial valve closed.
Figure 10:
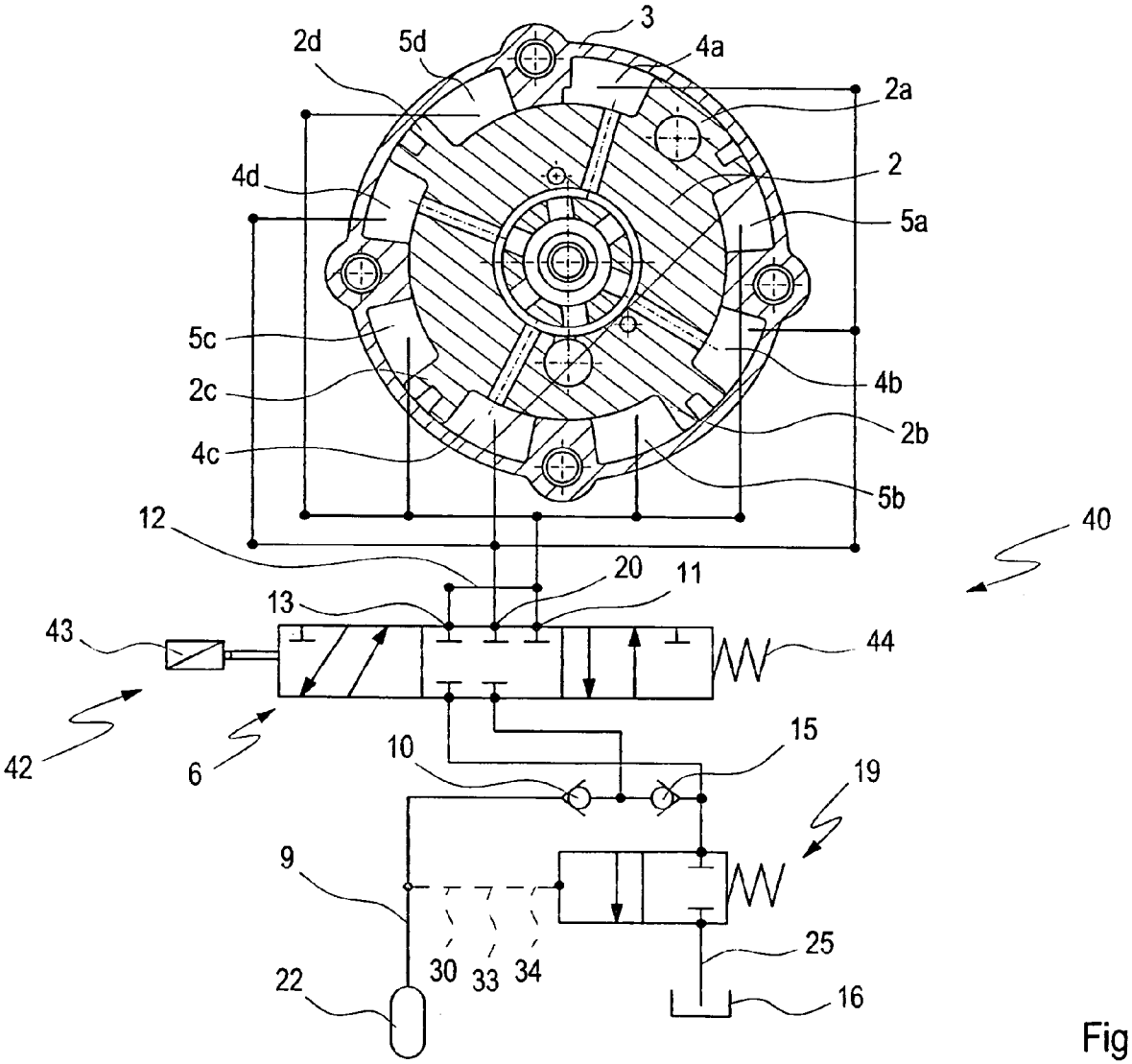
FIG. 10 shows the adjustment device according to FIG. 7 in a cross-sectional view with the associated hydraulic control circuit.
Figure 11:
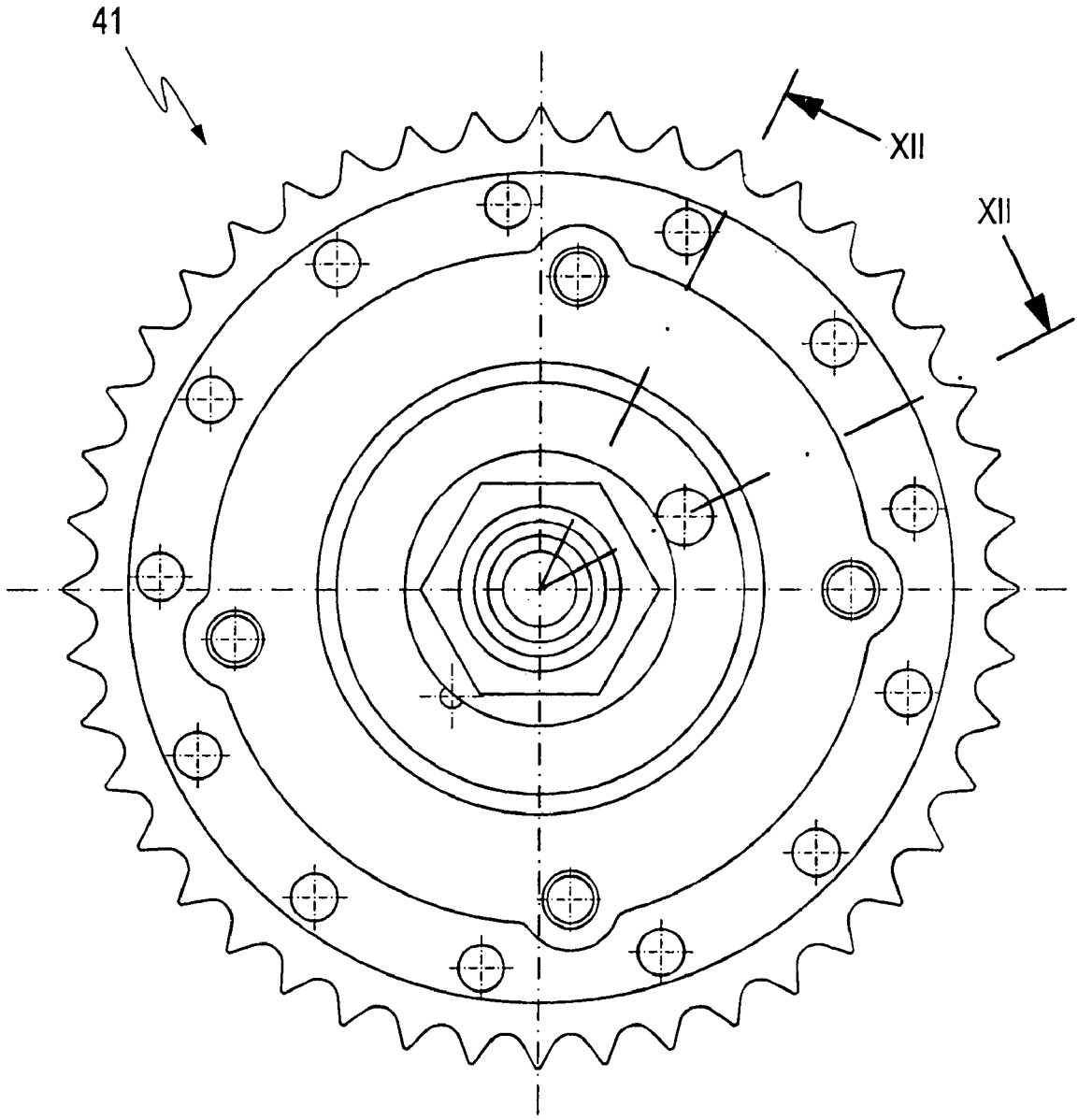
FIG. 11 shows the adjustment device in a transverse cross-sectional view including a throttling member in the oil pressure line of the advancement control valve.

The FIGS. 9 and 10 show the adjustment device in a neutral control position wherein the serial valve 19 is closed. Herein the control piston 8 closes with the annular webs 8*a* to 8*c*, the connections 11, 13 and 20 of the chambers 4*a* to 4*d* and 5*a* to 5*d* at the valve housing 7, whereby a change of the angular position of the valve adjustment device by an inflow of oil into one or several of the control chambers 4*a* to 4*d* or 5*a* to 5*d* and, respectively, by an outflow of oil from one or more of the control chambers 4*a* to 4*d* or 5*a* to 5*d* is prevented.

The arrangement of the first and the second check valve 10 or respectively 19 as shown in FIGS. 1 to 3, 5 and 6 as well as 8 and 9 within the control valve 6 has, on one hand, the advantage that it is very compact. Particularly the integration of the second check valve into an inner sleeve 18 in the interior of the control piston 8 makes an oil control changeover from the advancement chambers 4*a* to 4*d* to the retarding chambers 5*a* to 5*d* possible without the need for an additional third check valve for the switch-over operation. The position of the check valves within the control valve 6, which is integrated into the central mounting bolt 17 for mounting the adjustment device to the driven camshaft 1 on the other hand provides for a particularly compact construction of such an adjustment device.

The arrangement of the first and second check valves 10, or respectively, 19, within the adjustment device as shown in the drawings ensures furthermore a particularly cost effective manufacture and assembly of the adjustment device.

The adjustment device 19 is operated advantageously by the oil pressure which determines the particular mode of operation. At low speed and low oil pressure of an internal combustion engine, the camshaft is adjusted passively by way of the varying camshaft torque moments. At high engine speed and high oil pressures, the camshaft is actively adjusted by the pressurized hydraulic oil.

Figure 12:
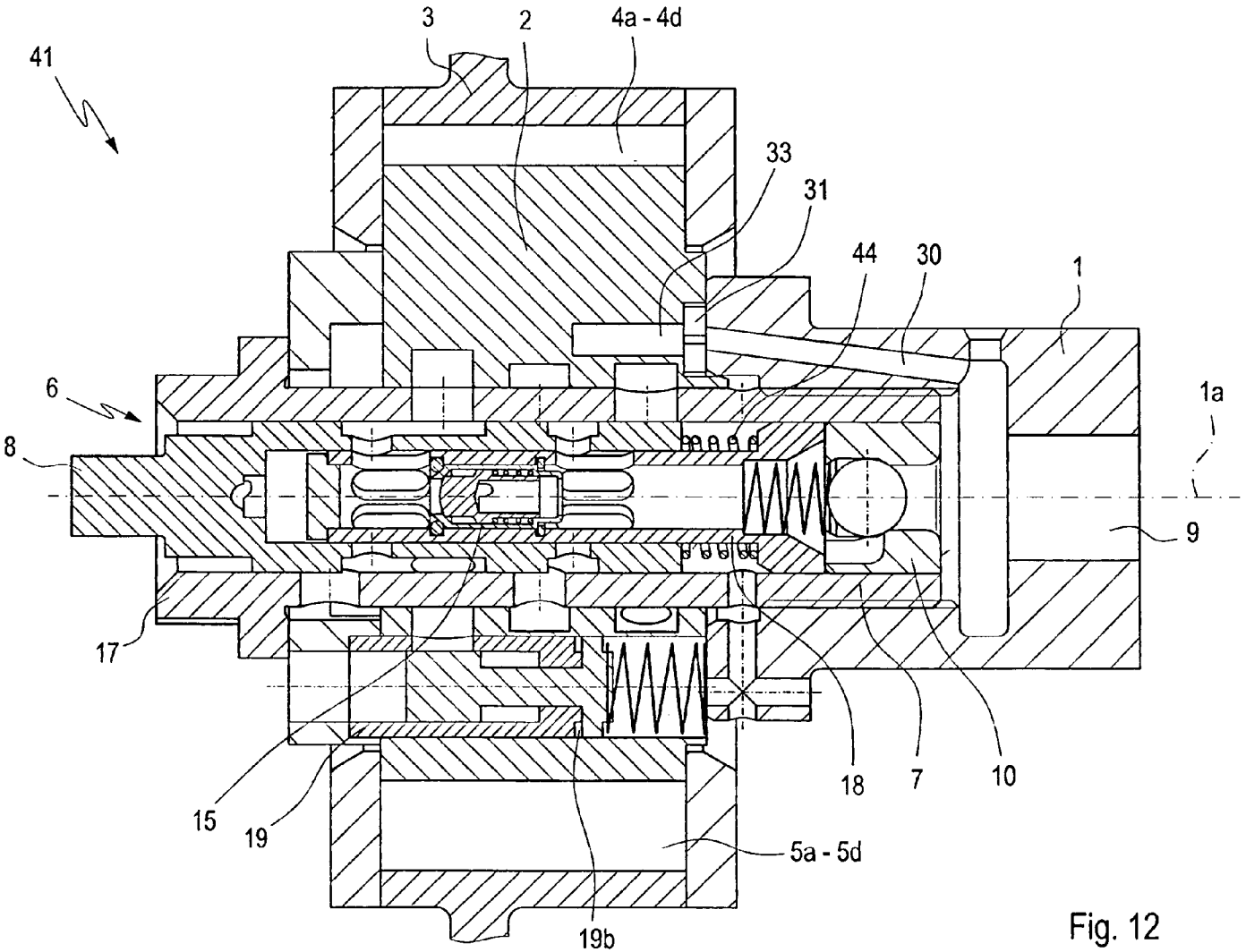
FIG. 12 shows the adjustment device according to FIG. 11 in a longitudinal cross-sectional view A-A.
Figure 13:
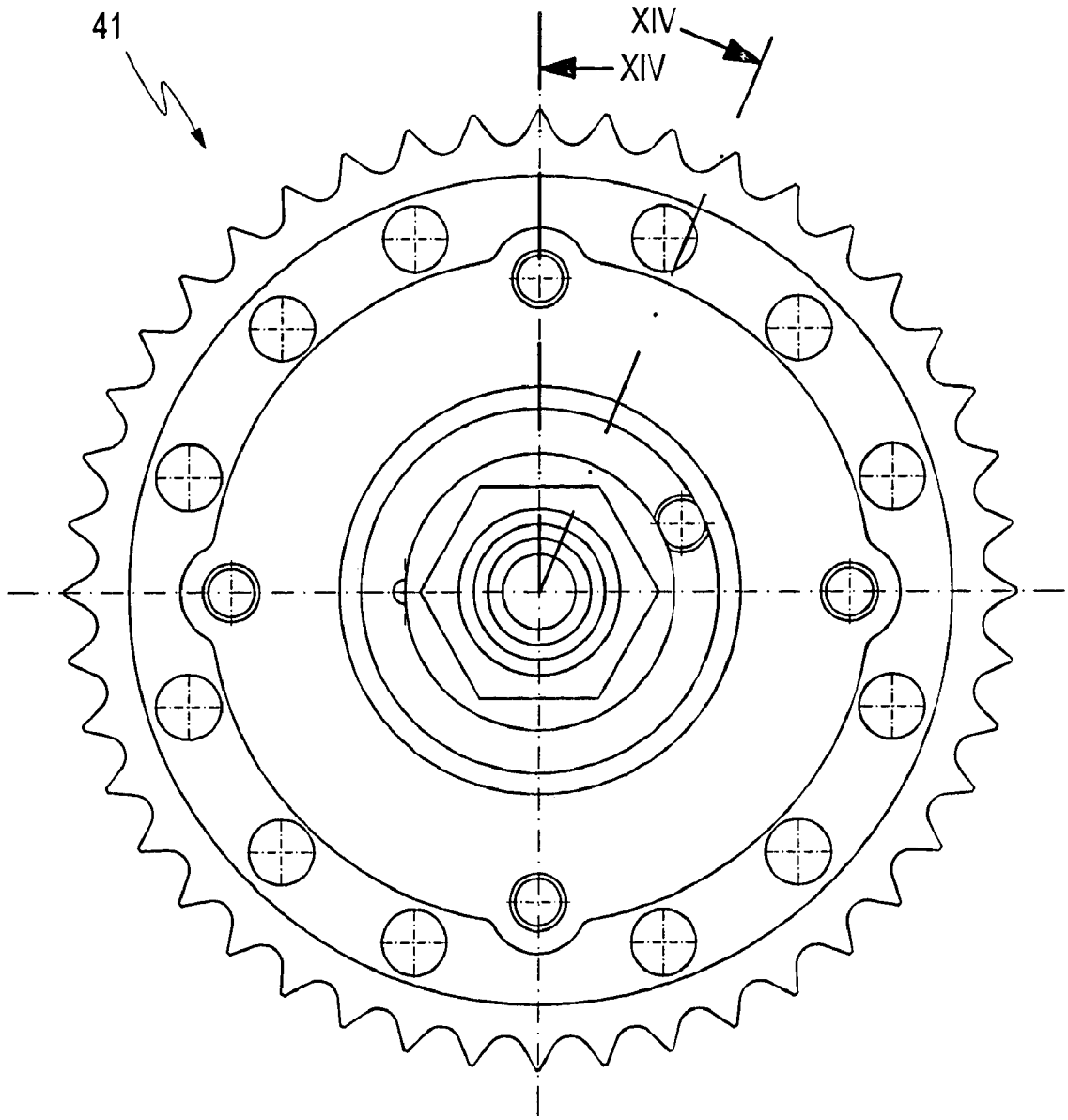
FIG. 13 shows the adjustment device in a transverse cross-sectional view with a throttle and a third check valve in parallel oil passages for pressurizing the serial valve.
Figure 14:
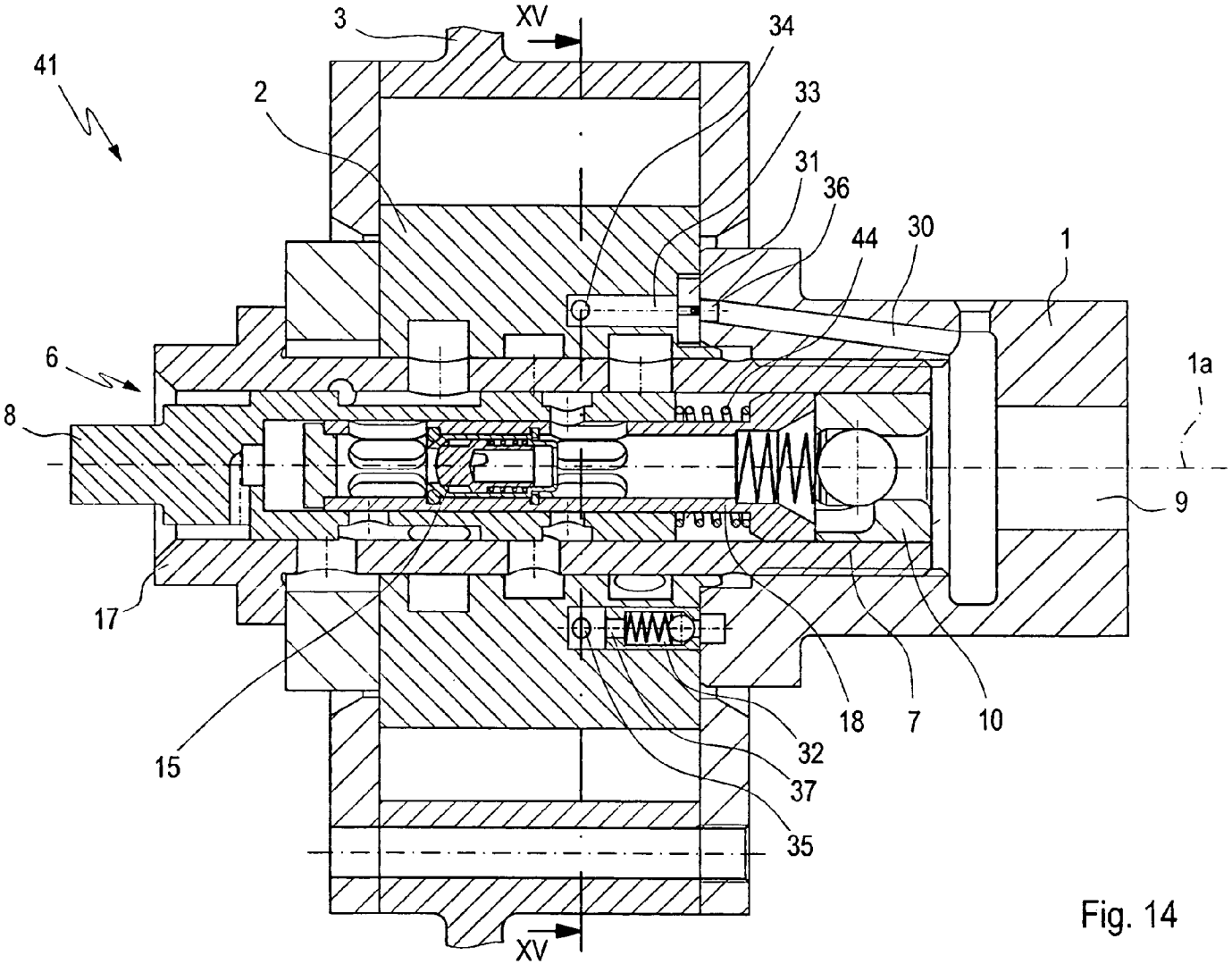
FIG. 14 shows the adjustment device according to FIG. 13 in the longitudinal cross-sectional view B-B.
Figure 15:
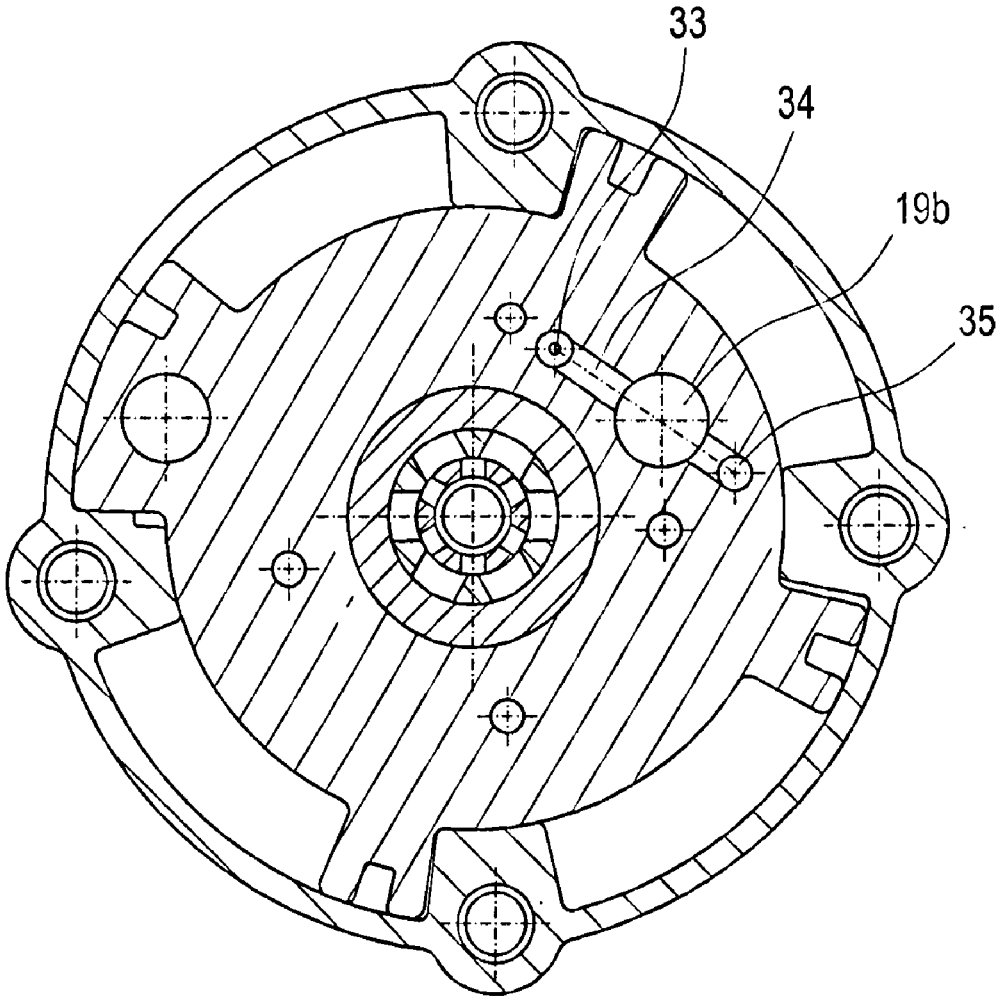
FIG. 15 shows the adjustment device in a transverse cross-sectional view with the connecting passages between the throttle, the third check valve and the pressure chamber of the serial valve.
Figure 16:
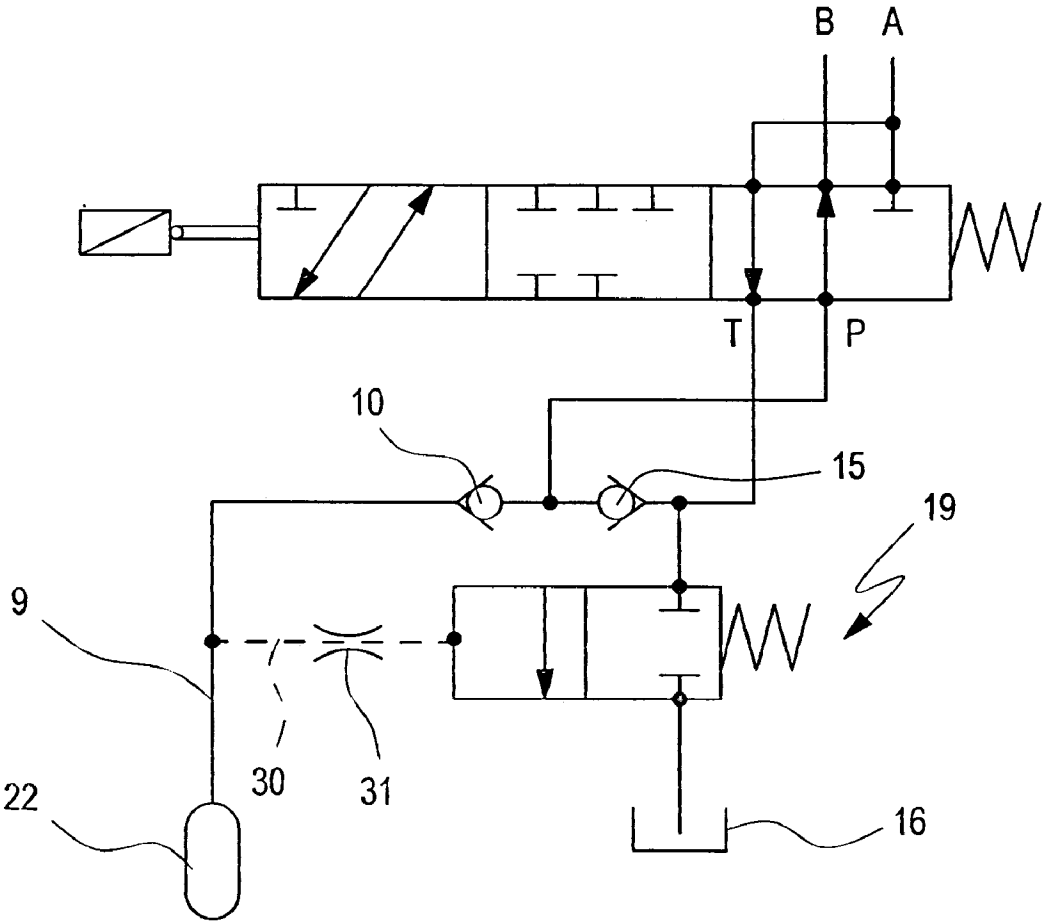
FIG. 16 shows schematically a hydraulic circuit for the adjustment device with a throttle in the oil supply of serial valve.
Figure 17:
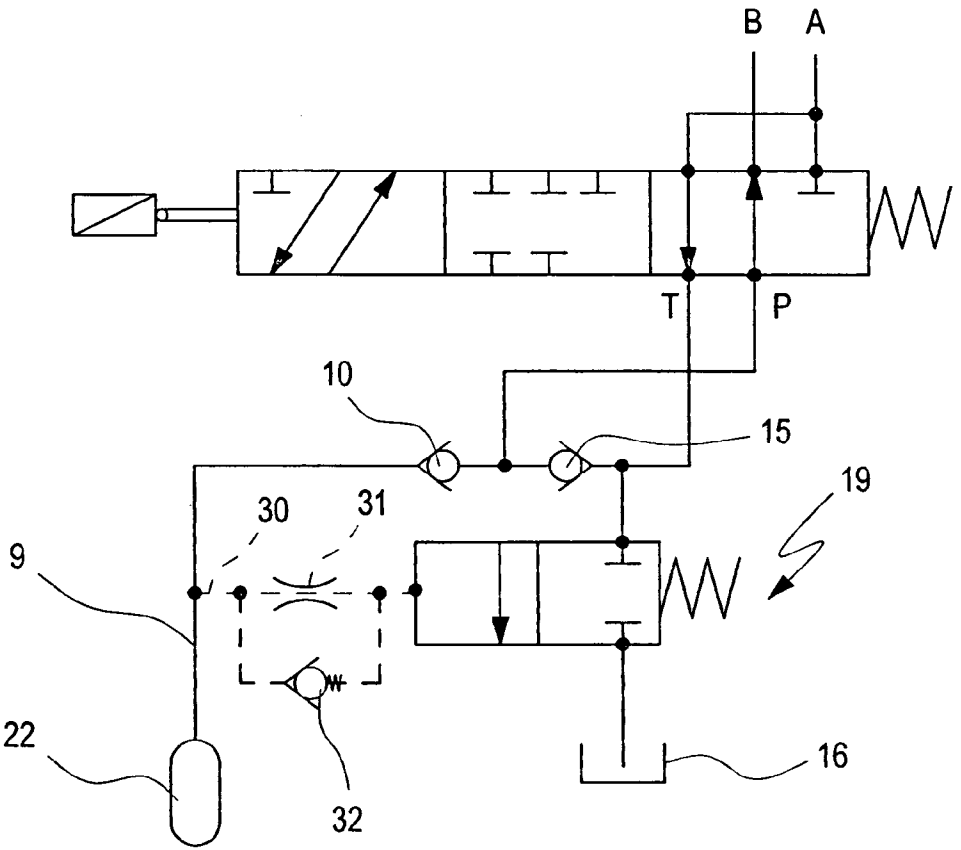
FIG. 17 shows schematically a hydraulic circuit for the adjustment device with a throttle and a check valve in two parallel passages for pressurizing the serial valve.

In accordance with the FIGS. 11 to 15, the serial valve 19 is advantageously not controlled directly by the oil pressure in the pressurized oil supply 9, but via an intermediate parallel circuit including a throttle member 31 arranged in a connecting line 30 extending between the pressurized oil supply 9 and the serial valve 19 and a third check valves 32. The FIGS. 12 and 13 show an embodiment of the associated oil paths from the connecting line 30 and the throttle 31, or, respectively, the third check valve 32 to the pressure space 19*b* of the serial valve 19. Herein the pressurized oil is conducted in the first parallel supply channel from the throttle 31 via the connecting line 33 and the transverse bore 34 forming a connecting passage to the pressure chamber 19*b* of the serial valve 19. In the second parallel supply channel, the pressurized oil is conducted from an annular connecting channel 36 via the third check valve 32, a channel section 37 and a transverse bore 35 to the pressure space 19*b* of the serial valve 19. This arrangement prevents on one hand a spontaneous switch-over from the passive to the active mode of operation with a low average pressure in the pressurized oil supply 9 to the adjustment device and small pressure peaks, but on the other hand, results in a less stable back switching from the active to the hydraulic passive mode of operation if the pressure drops for a short period for example as a result of an adjustment movement.

The serial valve 19 may advantageously be integrated into the adjustment device. In this case, the serial valve should be positioned so that its operating direction extends parallel to the axis of rotation of the camshaft adjuster in order to minimize the effects of centrifugal forces on the valve. Alternatively, a tangential installation position relative to the axis of rotation of the camshaft adjuster may be considered. As installation location for the serial valve 19 particularly the first and the second body but also a control valve which is not shown in the drawings may be considered or possibly the central mounting bolt, the drive wheel, or housing covers. It may also be located in one of the vanes or in the hub of the vane piston.

What is claimed is:

1. An adjustment device for adjusting the phase position of camshaft (1) with respect to a crankshaft of an internal combustion engine which includes a hydraulic system (40) for supplying hydraulic fluid to the adjustment device, comprising: an adjustment structure including operating chambers (4*a*-4*d*, 5*a*-5*d*), a control arrangement (42) including a control valve (6) for controlling the flow of hydraulic fluid to, and from, the operating chambers (4*a*-4*d*, 5*a*-5*d*), and a flow passage interconnecting the various operating chambers under the control of the control valve (6), said hydraulic system (40) including a pressurized hydraulic fluid supply line with a first check valve (10) arranged in a pressurized hydraulic fluid supply line (9) and the flow passage interconnecting the operating chambers (4*a*-4*d*, 5*a*-5*d*) including a second check valve (15), and a serial valve (19) connected to the control valve (6) for switching the adjustment device between a first operating mode, in which the camshaft is adjusted passively by changing camshaft torques, and a second operating mode, in which the camshaft is adjusted actively by controlling the admission of pressurized hydraulic fluid from a pressurized hydraulic fluid source to, and the release of the hydraulic fluid from, the operating chambers (4*a*-4*d*, 5*a*-5*d*).

2. An adjustment device as defined in claim 1, wherein the hydraulic system includes a hydraulic fluid pump (22) and the first check valve (10) is arranged so as to prevent a return of hydraulic fluid to the hydraulic fluid pump (22).

3. An adjustment device as defined in claim 1, wherein a second check valve (15) is arranged so as to permit return flow from the operating chambers (4*a*-4*d*) or, respectively, (5*a*-5*d*), which are becoming smaller, to the operating chamber (5*a*-5*d*) or, respectively (4*a*-4*d*), which are becoming larger, and to block hydraulic fluid flow in the opposite direction.

4. An adjustment device as defined in claim 3, wherein at least one of the first and the second check valves (10, 15) is arranged within or at a central mounting bolt (17) for mounting the adjustment device to the camshaft (1).

5. An adjustment device as defined in claim 3, wherein the first check valve (10) is disposed in an inner sleeve (18) of a valve housing (7) of the control valve (6).

6. An adjustment device as defined in claim 3, wherein at least one of the first check valve (10) and the second check valve (15) is disposed in or at the valve housing (6).

7. An adjustment device as defined in claim 1, wherein the serial valve (19) is controllable depending on the available hydraulic fluid pressure.

8. An adjustment device as defined in claim 1, wherein the serial valve (19) is provided at the adjustment device in an orientation such that its axis of movement extends parallel or tangentially to the axis of rotation of the adjustment device.

9. An adjustment device as defined in claim 1, wherein the serial valve (19) is connected to the hydraulic fluid supply line (9) via a hydraulic fluid, supply connecting line (30) and a throttle (31) is disposed in the hydraulic fluid supply connecting line (30) to the serial valve (19).

10. An adjustment device as defined in claim 9, wherein the hydraulic fluid connecting line (30) to the serial valve (19) includes a check valve (32).

11. An adjustment device as defined in claim 9, wherein at least two parallel supply lines (30, 36; 30, 33, 34) for the serial valve (19) are provided and one of the supply lines includes a throttle (31) whereas the others include a check valve (32).

12. An adjustment device as defined in claim 9, wherein at least one of the hydraulic fluid connecting lines (30, 36) and, respectively, (30, 33, 34) between the pressurized hydraulic fluid supply (9) and the serial valve (19) extends in the camshaft (1).

13. An adjustment device as defined in claim 12, wherein the adjustment device includes an inner part (2) and an outer part (3) and at least one of the hydraulic fluid connecting lines (30, 36) or respectively, (30, 33, 34) to the serial valve (19) is associated with the inner part (2) of adjustment device.

14. An adjustment device as defined in claim 13, wherein at least one of the check valve (19) and the throttle is associated with the inner part (2) of the adjustment device.

15. An adjustment device according to claim 1, wherein the valve housing (7) is connected to the camshaft by one of screwing, pressing, cementing, soldering, and welding.

16. An adjustment device according to claim 1, wherein an inner sleeve (18) of the control valve (6) is connected to the camshaft (1).

17. An adjustment device according to claim 16, wherein the inner sleeve (18) of the control valve (6) is formed integrally with the camshaft (1).

18. An adjustment device according to claim 1, wherein the serial valve is disposed at, or within, the valve housing (7), or within, or at, a mounting bolt (17) for mounting the adjustment arrangement to the camshaft (1).

* * * * *